US011435091B2

(12) United States Patent
Brake

(10) Patent No.: US 11,435,091 B2
(45) Date of Patent: Sep. 6, 2022

(54) LOW $NO_x$ TUBULAR MESH BURNER AND METHODS OF USE

(71) Applicant: Goodman Manufacturing Company LP, Houston, TX (US)

(72) Inventor: George R. Brake, Dickson, TN (US)

(73) Assignee: GOODMAN MANUFACTURING COMPANY LP, Houston, TX (US)

( * ) Notice: Subject to any disclaimer, the term of this patent is extended or adjusted under 35 U.S.C. 154(b) by 462 days.

(21) Appl. No.: 15/270,882

(22) Filed: Sep. 20, 2016

(65) Prior Publication Data

US 2018/0080659 A1 Mar. 22, 2018

(51) Int. Cl.
*F24D 5/02* (2006.01)

(52) U.S. Cl.
CPC ..... *F24D 5/02* (2013.01); *F23D 2203/002* (2013.01); *F23D 2203/103* (2013.01); *F23D 2203/1012* (2013.01); *F23D 2212/103* (2013.01); *F23D 2212/201* (2013.01)

(58) Field of Classification Search
CPC ..... F24D 5/02; F23D 14/12
USPC ..... 126/116 R
See application file for complete search history.

(56) References Cited

U.S. PATENT DOCUMENTS 3,169,572 A * 2/1965 Constance ..... F23D 14/14 431/329
4,904,179 A * 2/1990 Drago ..... F23D 14/70 126/11 OR
4,960,102 A * 10/1990 Shellenberger ..... F24H 3/087 126/11 OR
5,197,871 A * 3/1993 Yamamoto ..... F23D 3/40 126/11 OB
5,203,689 A * 4/1993 Duggan ..... F23D 14/74 122/17.1
5,240,411 A * 8/1993 Abalos ..... F23D 14/145 126/92 AC
5,520,536 A * 5/1996 Rodgers ..... F23D 14/02 126/116 R
5,649,529 A * 7/1997 Lu ..... F23M 9/06 126/11 OR
2004/0253559 A1* 12/2004 Schultz ..... F23D 14/48 431/354
2006/0040224 A1* 2/2006 Lovato ..... F23D 14/74 431/90
2012/0247444 A1* 10/2012 Sherrow ..... F24H 9/14 126/116 R

* cited by examiner

*Primary Examiner* — Allen R. B. Schult
(74) *Attorney, Agent, or Firm* — Baker Botts L.L.P.

(57) ABSTRACT

A tubular burner and methods of use in a furnace having reduced $NO_x$ emissions are provided. The tubular burner comprises a structural skeleton and a mesh screen disposed about the structural skeleton. The structural skeleton may be coupled to an air/fuel mixture source. The structural skeleton may comprise a hollow interior and a plurality of perforations to allow the air/fuel mixture to pass from the interior of the structural skeleton to the exterior. The burner systems may further comprise a plurality of holes spaced along and between the burners for cross-lighting of multiple burners using a single igniter.

20 Claims, 5 Drawing Sheets

LOW $NO_x$ TUBULAR MESH BURNER AND METHODS OF USE

TECHNICAL FIELD

The present disclosure relates generally to a tubular mesh or woven pre-mix burner for use with heating appliances such as furnaces. More specifically, the present disclosure relates to a tubular mesh or woven pre-mix burner configured to work with existing furnace design while generating reduced quantities of $NO_x$ emissions. The present disclosure further relates to methods for operating such a burner.

BACKGROUND

Commercial and residential furnaces rely on fossil fuel combustion to generate heat. This heat is then transferred to circulating air using heat exchangers to heat a house or building. However, burning any fossil fuel can result in many undesirable byproducts such as $NO_x$, $SO_x$, and $CO_x$. Many countries and regions now require that fossil fuel burning equipment complies with air quality standards and limitations. The particulars of these requirements vary widely depending on the industry or equipment being regulated as well as the particular geographic location in which the equipment is to be installed or operated.

Recently, many regions enacted stricter emissions standards for furnaces and other HVAC equipment. In particular, many regions are currently, or will soon be, enforcing tougher standards for $NO_x$ emissions. Burning fossil fuels is generally done in the presence of air, which is essentially a mixture of $O_2$ and $N_2$. As a result, this process has a tendency to generate at least some quantity of $NO_x$, which may be increased when the amount of air mixed with the fuel is not tightly controlled. The presence of excess air not required for complete combustion of the fuel increases the total amount of $NO_x$ generated. Moreover, higher amounts of $NO_x$ are expected as the combustion temperature increases.

Traditional furnaces generally comprise a tubular based heat exchanger that uses an inshot burner as a heat source. The inshot style of burner uses a single flame injection site that lends itself to high temperatures. Moreover, these burners do not have precise air regulation mechanisms and are therefore generally designed to have a high level of excess air in order to assure clean combustion. For current commercial furnaces, these factors combine to generate $NO_x$ emissions far higher than the minimum requirements of new and upcoming standards and regulations. Failure to comply with these new standards imposes harsh penalties, including a complete ban on the sale and installation of any product that is not compliant. Thus a need exists to create a new burner system that is compatible with current furnace design yet has low $NO_x$ emission.

SUMMARY

Examples of systems and methods are provided for using a tubular mesh or woven pre-mix burner inside a heating appliance. For instance, examples of systems and methods are provided for operating a furnace comprising one or more tubular burners to heat circulating air for a building. The tubular burner may exhibit reduced $NO_x$ emissions in compliance with new and forthcoming emissions standards and regulations.

The tubular burner of the present disclosure may comprise a structural skeleton coupled to an air/fuel mixture source. The structural skeleton may comprise a hollow interior and a plurality of ports configured to allow the air/fuel mixture to pass to the exterior of the structural skeleton. The tubular burner may further comprise a mesh screen disposed about the structural skeleton. The mesh screen may be configured to support and maintain a flame along its outer surface. Mixing of the air/fuel mixture prior to introducing it to the burner allows for increased control of the quantity of excess combustion air. Further, spreading the flame along the entire outer surface of the mesh screen maximizes heat transfer while keeping the overall flame temperature low.

The burners of the present disclosure are suitable for use with conventional furnace designs. Existing burners may be replaced with the burners of the present disclosure to reduce the $NO_x$ emissions of the system. The burners of the present disclosure may further comprise a plurality of holes disposed along the exterior of the tubes and furnace components. These holes may be used as a cross-lighting mechanism to spread a flame from one burner tube to another. Accordingly, a single igniter may be used to light all burners in a furnace.

These and various other features and advantages will be apparent from a reading of the following detailed description and drawings along with the appended claims. While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DESCRIPTION

Figure 1:
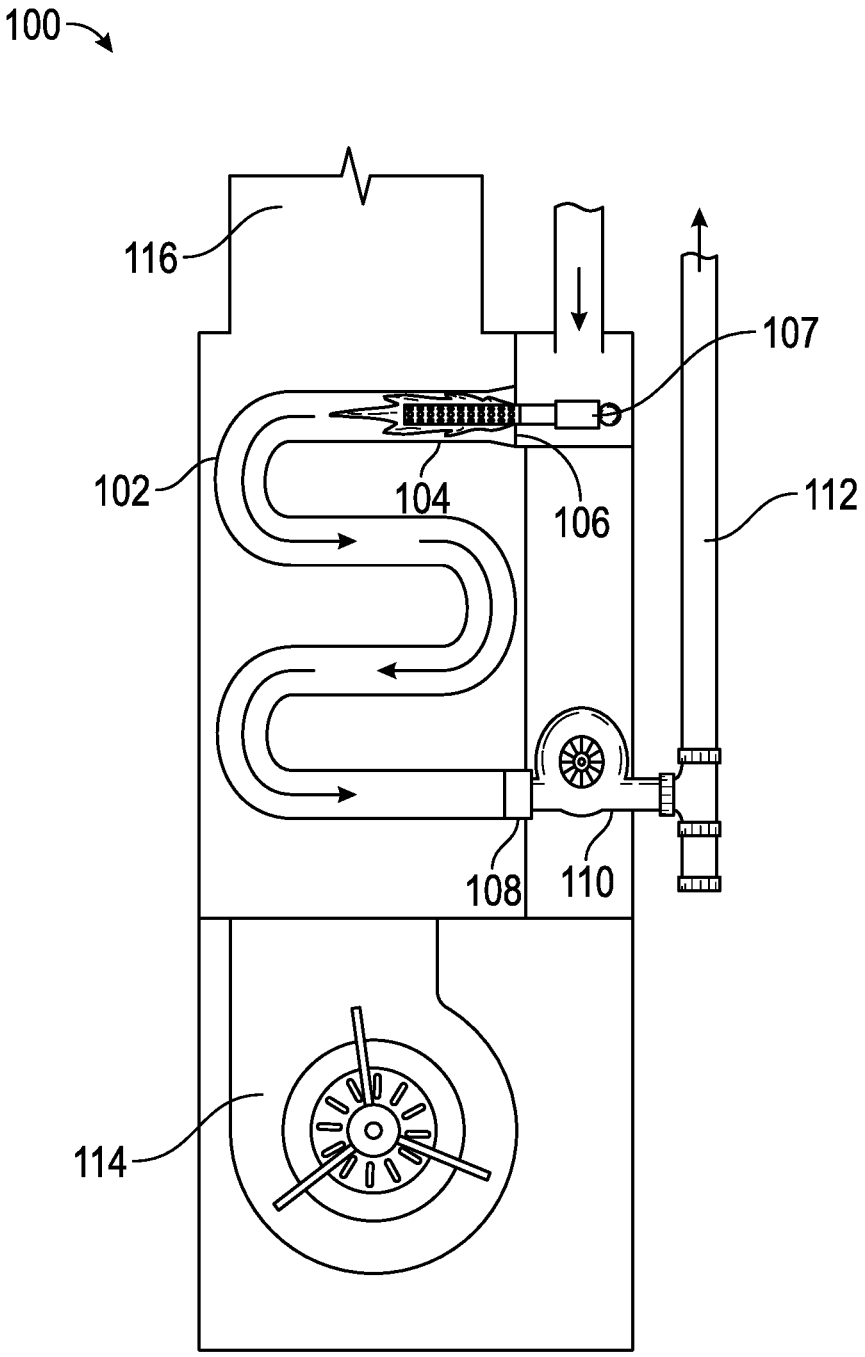
FIG. 1 is a schematic representation of a heating appliance.

This disclosure relates generally to a tubular burner for use with a fuel-fired heating appliance. Specifically, this disclosure relates to a tubular mesh or woven pre-mix burner that is suitable for meeting heating requirements while generating reduced $NO_x$ emissions in compliance with newly updated industry standards and local regulations.

The term combustion generally refers to a high-temperature exothermic chemical reaction between a fuel and an oxidant. Aside from heat, combustion generally results in the generation of one or more gaseous emissions, referred to as combustion byproducts. Combustion of a hydrocarbon fuel source in the presence of oxygen, the oxidant, generally results in the formation of $CO_2$ and $H_2O$ as combustion byproducts. Complete combustion refers to a reaction that occurs in the presence of high amounts of oxygen, i.e. where there is a sufficient amount of oxygen to react with each carbon and hydrogen atom to form $CO_2$ and $H_2O$. Incomplete combustion occurs when there is an insufficient amount of oxygen. Incomplete combustion generally results in the creation of less desirable combustion byproducts, such as carbon monoxide.

Because of the high amounts of heat generated, combustion of fossil fuels is used for a wide array of industrial and commercial purposes. For purposes of this disclosure, the term burning generally refers to the combustion of one or more hydrocarbon based fossil fuels in the presence of oxygen. This burning is generally done with ambient air as the primary oxygen source for combustion. Generally, the composition of air is approximately 21% oxygen ($O_2$) and 79% nitrogen ($N_2$). Nitrogen is generally not an oxidant, and at low combustion temperatures it does not participate in the combustion reaction. However, as the total nitrogen concentration increases, the likelihood that some of the nitrogen will react with oxygen to create $NO_x$ also increases. Furthermore, as combustion temperature increases, the likelihood that the nitrogen will react with the oxygen also increases. The presence of $NO_x$ as a combustion byproduct is undesirable as there are significant health, safety, and environmental concerns surrounding the presence of $NO_x$. Many industries and governments impose strict limitations on the quantities of $NO_x$ emitted from any particular process or piece of equipment.

A traditional furnace operates by burning fossil fuels in the presence of air to generate heat. The hot combustion products and byproducts are then pushed or pulled through the tubes of a heat exchanger assembly using an air blower or fan. The fossil fuel may be any type of fossil fuel suitable for combustion, including, but not limited to, natural gas. A second air blower passes circulating air from a building or home over the outside of the heat exchanger tubes to collect the heat and provide heated air for the building or home. Traditional furnace designs typically rely on inshot style burners for combustion. However, inshot burners are designed to work with excess combustion air in order to assure complete combustion and don't necessarily maintain a tight control of the air/fuel ratio over the range of operating/installation conditions. Typical inshot style burners may also have high temperature swings or localized high temperature spots. Both of these features of inshot style burners make them likely to generate levels of $NO_x$ emissions that are not in compliance with newer standards and regulations.

The present disclosure is directed to a tubular burner that may be used with existing furnace design that generates significantly reduced quantities of $NO_x$ emissions. The tubular burner may be a pre-mix burner. A pre-mix burner is a burner that has a separate chamber for mixing of the fuel and combustion air before said mixture is fed to the burner. The burner may generally comprise a mesh screen or woven material disposed about a hollow tubular skeleton. The mesh screen allows the flame to spread along its entire surface, thus generating a uniform flame temperature and eliminating hot spots that would otherwise increase $NO_x$ generation. A plurality of ports along the tubular skeleton may also be configured to control the quantities of air/fuel mixture passing through to the surface of the mesh screen, thereby directing the flow of reactants away from potential hot spots. The burner of the present disclosure may also provide for tighter control of the quantities of air and fuel fed to the combustion flame, thereby limiting the amount of excess nitrogen present during combustion.

The present disclosure is now described in detail with reference to one or more embodiments thereof as illustrated in the accompanying drawings. In the following description, numerous specific details are set forth in order to provide a thorough understanding of the present disclosure. However, the present disclosure may be practiced without some or all of these specific details. In other instances, well known process steps and/or structures have not been described in detail in order not to unnecessarily obscure the present disclosure. In addition, while the disclosure is described in conjunction with the particular embodiments, it should be understood that this description is not intended to limit the disclosure to the described embodiments. To the contrary, the description is intended to cover alternatives, modifications, and equivalents as may be included within the spirit and scope of the disclosure as defined by the appended claims.

FIG. 1 is a simplified schematic depiction of a conventional furnace design using an inshot style burner (prior art). Only one heat exchanger tube and burner are shown, but the furnace may generally comprise multiple sets of tubes and burners. As depicted, furnace 100 comprises a heat exchanger tube 102 comprising a first end 104 coupled to a burner plate 106. As would be understood by one of ordinary skill in the art, furnace 100 may alternatively comprise a heat exchanger tube and secondary heat exchanger assembly (not shown). Burner 107 is coupled to burner plate 106 and extends inward into the inner circumference of heat exchanger tube 106. A second end 108 of heat exchanger tube 102 is coupled to induced draft fan 110. An exhaust vent 112 is coupled to the outlet of induced draft fan 110. Induced draft fan 110 pulls the combustion products through heat exchanger tube 102 and eventually passes them out of the furnace through exhaust vent 112. As would be appreciated by one of ordinary skill in the art, induced draft fan 110 could be replaced by a forced draft fan pushing air through heat exchanger tube 106. Furnace 100 further comprises a house air blower 114 configured to blow circulating air across heat exchanger tube 102. As the circulating air passes over heat exchanger tube 102, the hot combustion products transfer heat across heat exchanger tube 102 to the circulating air, heating the air before it enters the house through supply plenum 116.

Figure 2:
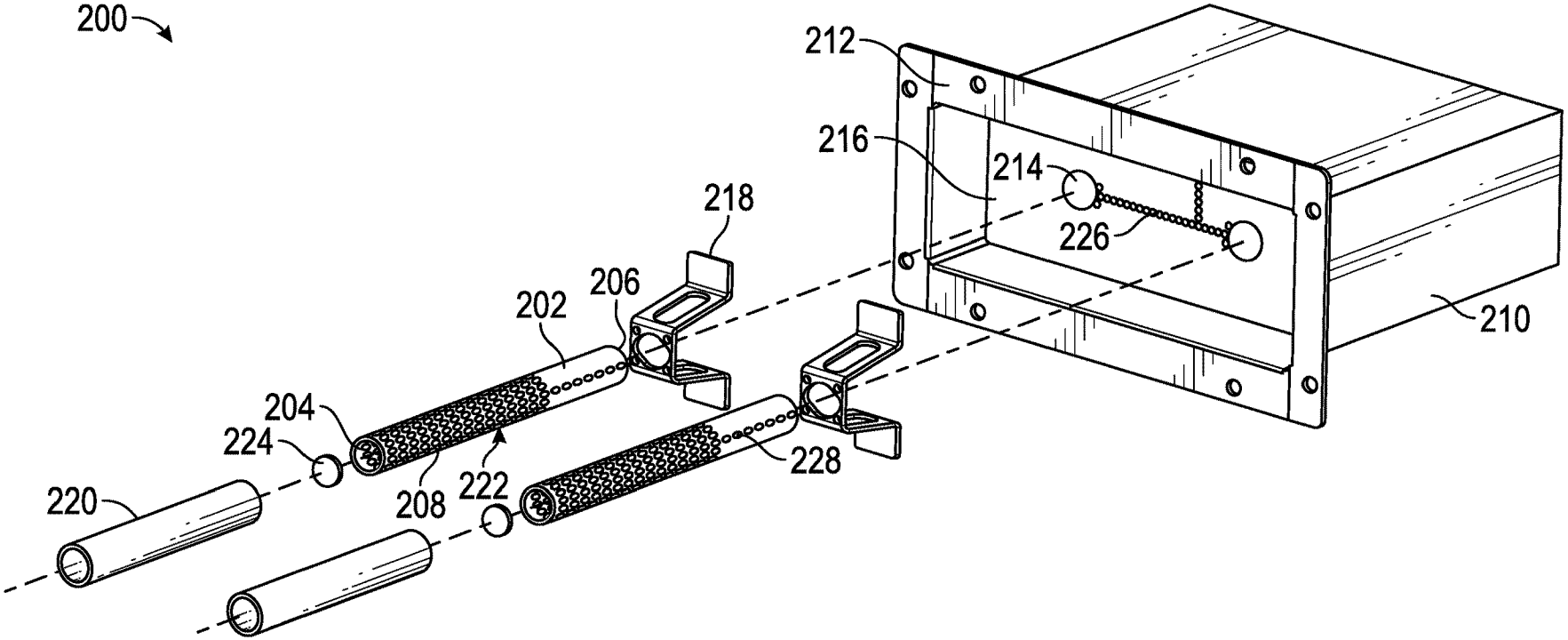
FIG. 2 is a schematic representation of a burner in accordance with some embodiments of the present disclosure.

FIG. 2 is a schematic depiction of two burners 200 in accordance with an embodiment of this disclosure. As depicted, burners 200 are shown unassembled for clarity. The burner 200 may include structural skeleton 202. Structural skeleton 202 may generally comprise a hollow tubular defining a hollow interior 204. Structural skeleton 202 may comprise a first end 206 and a second end 208. The first end 206 may be coupled to an air/fuel mixer 210. The air/fuel mixer 210 may provide a controlled air/fuel mixture to burner 200. The first end 206 of structural skeleton 202 may be coupled to air/fuel mixer 210 at burner plate 212. Burner plate 212 may comprise a generally flat metal plate coupled to at least a portion of air/fuel mixer 210 having a plurality of air/fuel ports 214 positioned along its exterior surface 216. Air/fuel ports 214 may be configured to support structural skeletons 202. Accordingly, air/fuel ports 214 may be sized to have a diameter that is slightly larger than that of structural skeletons 202. The first end 206 of structural skeleton 202 may be inserted into air/fuel port 214 and mechanically attached to create at least a partial seal between air/fuel port 214 and structural skeleton 202. This seal may then direct the air/fuel mixture from air/fuel mixer 210 into the hollow interior 204 of structural skeleton 202.

Burner 200 may optionally comprise one or more supports 218 coupled to and extending from burner plate 212. The supports 218 may be configured to provide further support for structural skeleton 202. As would be understood by one of ordinary skill in the art, having the benefit of the present disclosure, the supports 218 may be necessary when burner 200 is too large to be properly supported by coupling it to burner plate 212 using air/fuel ports 214 alone. Structural skeleton 202 may generally provide structural support for burner 200 while allowing an air/fuel mixture to pass through hollow interior 204.

Burner 200 may further comprise mesh screen 220 positioned about the exterior circumference of the second end 208 of structural skeleton 202. Mesh screen 220 may generally comprise a tubular metal lattice material suitable for exposure to combustion temperatures. Mesh screen 220 may be configured so that the lattice is large enough to allow the air/fuel mixture to pass through it with minimal restriction. Mesh screen 220 may be constructed from a mesh or woven material comprising a metal alloy fiber or ceramic material. The second end 208 of structural skeleton 202 may comprise a plurality of perforations 222 disposed along an exterior surface of structural skeleton 202. The plurality of perforations 222 may be configured to allow the air/fuel mixture to pass from hollow interior 204 to mesh screen 220. Mesh screen 220 may be configured to support and maintain a flame along an exterior surface of mesh screen 220. An igniter (not shown) may initiate a flame which will carry along the tube 202 and to the outer circumference of mesh screen 220. Burner 200 may be configured to maintain the flame by feeding the controlled air/fuel mixture from air/fuel mixer 210 through structural skeleton 202 to mesh screen 220. Burner 200 may further comprise a cap 224 coupled to the second end 208 of structural skeleton 202. Cap 224 may comprise a mesh material similar to mesh screen 220 and configured to allow a portion of the air/fuel mixture to pass through cap 224. Alternatively, cap 224 may comprise a solid metal material configured to prevent the air/fuel mixture from passing through cap 224.

Burner 200 may further comprise a cross-lighting mechanism for carrying a flame from a single igniter (not shown) to all burners of a particular heating appliance. The cross-lighting mechanism may comprise a plurality of burner plate holes 226 positioned along the exterior surface 216 of burner plate 212. The cross-lighting mechanism may further comprise a plurality of skeleton holes 228 positioned along the first end 206 of structural skeleton 202. The plurality of burner plate holes 226 and skeleton holes 228 may be sized to allow a small amount of the air/fuel mixture to pass through them. Once the igniter (not shown) initiates a flame along the mesh screen 220 of a burner 200, the flame may spread from to all other burners via the burner plate holes 226 and skeleton holes 228. Burner plate holes 226 and skeleton holes 228 are sized and spaced so as to allow an amount of air/fuel mixture to pass through sufficient to create a flame large enough to ignite the air/fuel mixture passing through any adjacent holes. As would be understood by one of ordinary skill in the art having the benefit of the present disclosure, the igniter (not shown) may be used to initiate a flame directly on the mesh screen 220 of a burner 200. Alternatively, it would be understood that the igniter could initiate a flame at any location containing burner plate holes 226 or skeleton holes 228 connected sequentially to burners 200 of the heating appliance. The flame may then propagate from one hole to the next until all holes and burners are ignited.

Figure 3A:
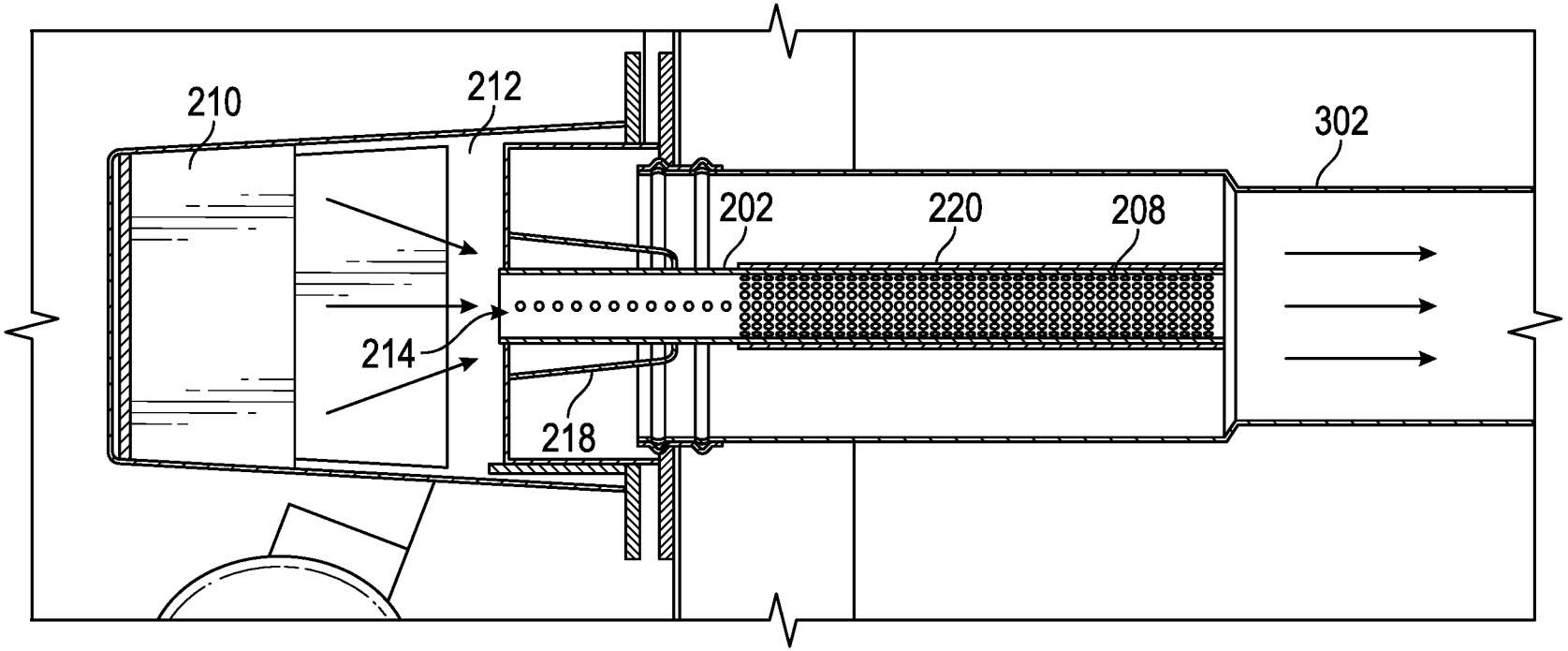
FIG. 3*a* is cross-sectional side view of an embodiment of a burner in use in a furnace.

FIG. 3*a* is a cross-sectional side view of a burner in accordance with the present disclosure shown installed in a heat exchanger tube. Structural skeleton 202 is shown coupled to burner plate 212 with optional supports 218 installed for additional structural support. The second end 208 of structural skeleton 202 may be installed such that mesh screen 220 rests in a relatively central location inside heat exchanger tube 302. Locating mesh screen 220 in the center of heat exchanger tube 302 aids in the prevention of flame impingement, which could lead to incomplete combustion and poor heat exchange. In operation, an amount of air and fuel are fed to air/fuel mixer 210 where they mix before being fed through air/fuel port 214 into structural skeleton 202. In one or more embodiments, the combustion products may be forced through the heat exchanger tube 302 using a forced draft fan (not shown). In other embodiments, the combustion products may be drawn through the heat exchanger tube 302 by an induced draft fan (not shown). As the air/fuel mixture passes through structural skeleton 202, it may pass through the perforations (not expressly shown) along structural skeleton 202 and then through the lattice of mesh screen 220 where it is burned.

Figure 3B:
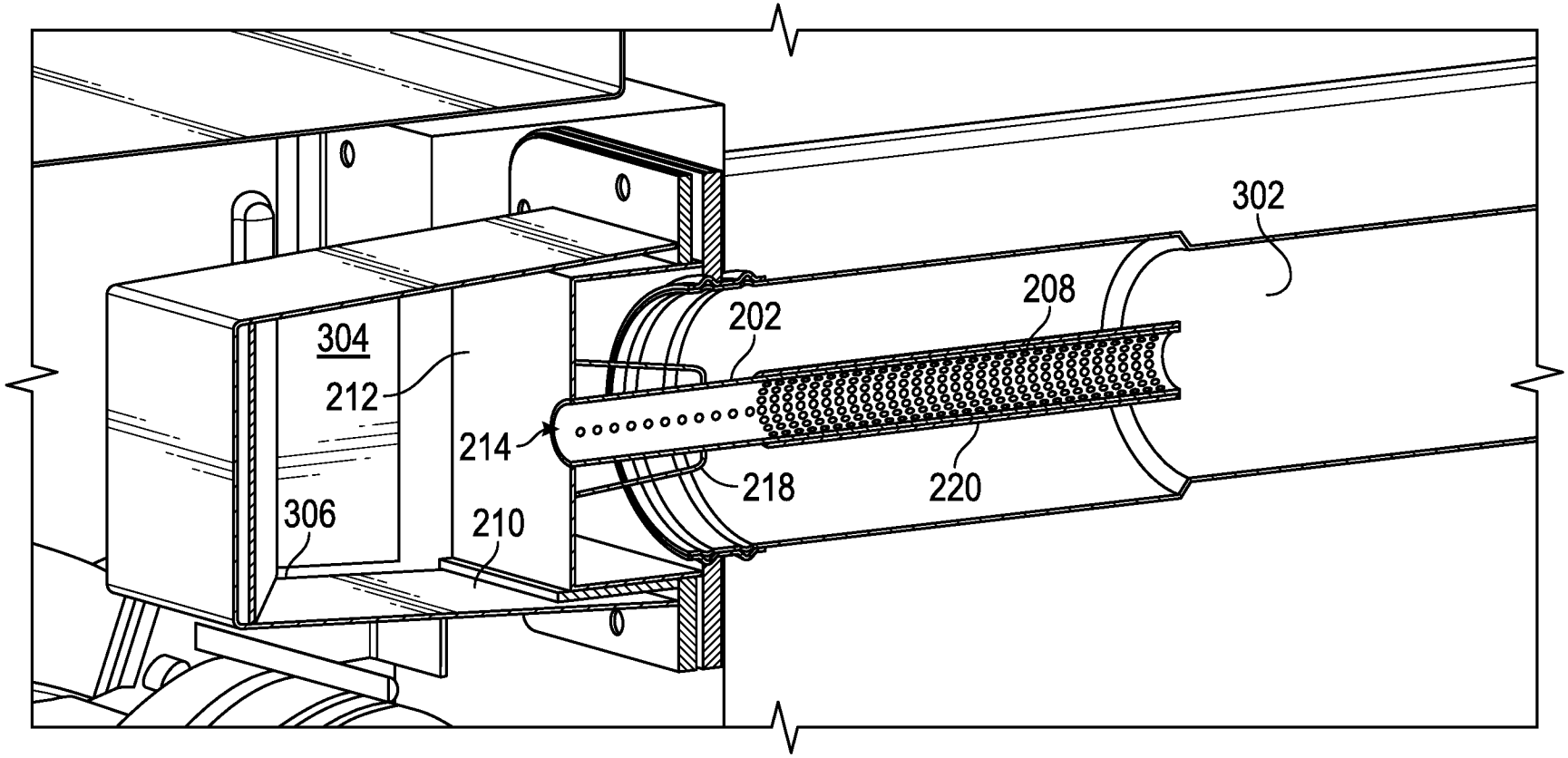
FIG. 3*b* is a perspective view of an embodiment of a burner in use in a furnace.

FIG. 3*b* is a perspective view of the same burner installed in a heat exchanger tube. Structural skeleton 202 is shown coupled to burner plate 212 with optional supports 218 installed for additional structural support. Air/fuel mixer 210 may comprise a mixing chamber 304 where the flow of air and fuel may be controlled and uniformly mixed before feeding into structural skeleton 202. The flow of air and fuel into the air/fuel mixer 210 may be controlled by one or more control mechanisms 306 coupled to the inlet to air/fuel mixer 210. The control mechanism 306 may be any suitable means known in the art, including, but not limited to, valves, orifices, dampers, mixing vanes, and turbulators. By premixing the air and fuel, it is possible to provide an amount of oxygen that is sufficient for complete combustion, without providing excess, which could lead to increased $NO_x$ generation. In one or more embodiments, an amount of air and an amount of fuel may be fed directly into the air/fuel mixer 210 to be mixed before feeding into structural skeleton 202. In other embodiments, the air and fuel may be mixed in a separate chamber or location before being introduced into air/fuel mixer 210.

As would be understood by one of ordinary skill in the art having the benefit of this disclosure, the length and diameter of structural skeleton 202 may be varied to optimize the operating conditions of the heating appliance. By increasing the length of the second end 208 of the structural skeleton, a longer flame may be maintained along mesh screen 220. The longer flame will increase the surface area of the flame, thereby increasing the amount of heat generated, while keeping the overall flame temperature minimized to limit the production of $NO_x$ byproducts. The diameter of structural skeleton 202 may also be varied to adjust the amount of air/fuel mixture feeding the mesh screen 220. A structural skeleton 202 having a larger diameter will generally result in an increase in the amount of the air/fuel mixture that is capable of flowing through it. The diameter of structural skeleton 202 may be limited by the diameter of heat exchanger tube 302. The length and diameter of the tube, the area of the mesh, and the gas input can all be adjusted to achieve the proper "port loading" of the mesh and corresponding pressure drop through the burner.

Figure 4:
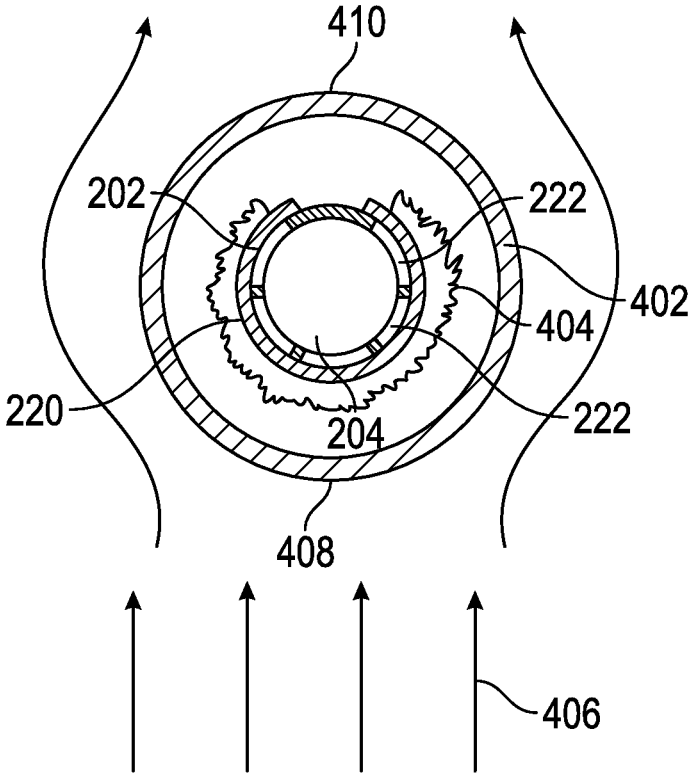
FIG. 4 is a cross-sectional front view of an embodiment of a burner in use in a furnace.

FIG. 4 is a cross-sectional view of an inlet of a heat exchanger tube with a tubular mesh burner installed in accordance with the present disclosure. Structural skeleton 202 is shown in the relative center of heat exchanger tube 402. Structural skeleton 202 may be surrounded by mesh sleeve 220. Mesh screen 220 may completely surround structural skeleton 202. Alternatively, mesh screen 220 may have leave a portion of structural skeleton 202 exposed. As discussed above, structural skeleton 202 may have a plurality of perforations 222 spaced around its body. The air/flow mixture passes through the hollow interior 204 of structural skeleton 202 and through the perforations 222 to feed the flame 404 propagated along mesh screen 220. The perforations 222 may be spaced so as to direct or control the intensity of flame 404. As circulating air passes over heat exchanger tube 402 along a flowpath 406, it cools the near portion 408 of heat exchanger tube 402 directly perpendicular to the incoming cooler circulation air. Likewise, as the air passes along the far side of heat exchanger tube 402, the far portion 410 does not receive as much cooling and will typically reach higher temperatures. The perforations 222 may be spaced and sized to direct the intensity of flame 404 away from the far portion 410 of heat exchanger tube 402, thereby generating a more uniform temperature distribution.

The methods of the present disclosure are suitable for providing heat to a building such as a residential home or commercial space. A heating appliance, including, but not limited to, a furnace, may be used as a heat source for said building. The heating appliance may be coupled to the building through a circulating air supply plenum. The heating appliance may generally comprise an air blower that may be used to circulate air throughout the building via the use of air ducts installed throughout the rooms, walls, ceilings, and floors of the building. The circulating air may be heated using the heating appliance.

One or more tubular mesh burners in accordance with the present disclosure may be ignited using one or more igniters. A combustion air stream comprising an amount of air and an amount of fuel may be fed to the burners. The combustion air stream may be pre-mixed in an air/fuel mixer coupled to the one or more mesh burners. Igniting the one or more burners may generally comprise generating a flame along the exterior of the mesh screen positioned around the structural skeleton of the burner by burning a portion of the combustion air stream. A fan may then be used to pass the combustion products through the interior of the heat exchanger tubes of the heating appliance. The fan may be an induced draft fan that pulls the combustion products through the heat exchanger tubes. Alternatively, the fan may be a forced draft fan that pushes the combustion products through the heat exchanger tubes. As the blower passes the circulating air over the outside of the heat exchanger tubes, the temperature differential causes heat to transfer to the circulating air. The heated circulating air may then be passed into the home to control the temperature therein.

The amount of $NO_x$ generated by the burners may be limited by controlling the temperature of the flame and the quantity of air fed to the flame. The temperature of the flame may be controlled by selectively sizing the structural skeleton and mesh screen to spread the flame across a larger surface area. Selectively sizing the structural skeleton may be done by many methods, including, but not limited to, increasing their respective length and diameters. The temperature of the flame generated on the mesh screens may generally be about 3000° F. or less when natural gas is the fuel source. The amount of air fed to the flame may be controlled using the one or more control mechanisms coupled to the air/fuel mixer. Controlling the air/fuel mixture and flame temperature may generally generate lower $NO_x$ emissions than standard heating appliances. The amount of $NO_x$ emitted when using one or more burners in accordance with the present disclosure may generally be less than about 14 Ng/J and "single digit" Ng/J $NO_x$ levels can frequently be obtained. The $NO_x$ measurements are obtained using California's AQMD Method 100.1 as referenced in SCAQMD Rule 1111.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, feature, functions, operations, or steps, any of these embodiments may include any combination or permutation of any of the components, elements, features, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative.

What is claimed is:

1. A burner for use in a heating appliance comprising:

a structural skeleton comprising:

a first end coupled to an air/fuel mixer;

a hollow interior; and a plurality of perforations disposed solely along a second end of the structural skeleton configured to control and direct a flow of an air/fuel mixture through the structural skeleton from the hollow interior to an exterior portion of the structural skeleton, wherein the structural skeleton is disposed within a heat exchanger tube and wherein the plurality of perforations are positioned along a body of the structural skeleton to direct a flame towards a direction of a circulating air stream passing over an exterior of the heat exchanger tube;

a plurality of skeleton holes positioned solely in a substantially straight line along the first end of the structural skeleton to allow the flame to be carried between the first end and the second end;

a mesh screen disposed about the structural skeleton configured to maintain the flame along an outer circumference of the mesh screen, wherein the mesh screen is configured to allow the air/fuel mixture to pass through the mesh screen and allow the flame to spread along an external surface of the mesh screen; and a cap coupled to the second end of the structural skeleton, wherein the cap comprises a solid material configured to prevent the air/fuel mixture from passing through the cap.

2. The burner of claim 1, further comprising a plurality of holes positioned along the first end of the structural skeleton.

3. The burner of claim 2, wherein the plurality of holes are sized and spaced such that a flame may propagate from one hole to an adjacent hole.

4. The burner of claim 1, wherein the second end of the structural skeleton comprises a length configured to minimize a temperature of the flame.

5. The burner of claim 1, wherein the burner is configured to generate less than 14 Ng/J of $NO_x$.

6. A combustion system for use in a heating appliance comprising:

one or more heat exchanger tubes, each of the heat exchanger tubes comprising a first end coupled to a burner plate, wherein the burner plate comprises one or more ports configured to pass an air/fuel mixture through the burner plate and corresponding to each of the heat exchanger tubes;

an air/fuel mixer coupled to the burner plate;

one or more burners disposed within each of the first ends of the heat exchanger tubes and coupled to the corresponding ports, each of the burners comprising:

a structural skeleton comprising:

a first end coupled to the air/fuel mixer;

a hollow interior; and a plurality of perforations disposed solely along a second end of the structural skeleton configured to control and direct a flow of the air/fuel mixture through the structural skeleton from the hollow interior to an exterior portion of the structural skeleton, wherein the plurality of perforations are positioned along a body of the structural skeleton to direct a flame towards a direction of a circulating air stream passing over an exterior of the one or more heat exchanger tubes;

a plurality of skeleton holes positioned solely in a substantially straight line along the first end of the structural skeleton to allow the flame to be carried between the first end and the second end;

a mesh screen disposed about the structural skeleton and proximate to the structural skeleton, the mesh screen configured to maintain the flame along an outer circumference of the mesh screen, wherein the mesh screen is configured to allow the air/fuel mixture to pass through the mesh screen and allow the flame to spread along an external surface of the mesh screen; and a cap coupled to the second end of the structural skeleton, wherein the cap comprises a solid material configured to prevent the air/fuel mixture from passing through the cap.

7. The combustion system of claim 6, further comprising an induced draft fan coupled to a second end of the heat exchanger tube.

8. The combustion system of claim 6, further comprising a forced draft fan coupled to the air/fuel mixer.

9. The combustion system of claim 6, further comprising a cross-lighting mechanism.

10. The combustion system of claim 9, wherein the cross-lighting mechanism further comprises a plurality of ports positioned along the burner plate and the first end of the structural skeleton configured to propagate the flame from one burner to the other burners.

11. The burner of claim 6, wherein the second end of the structural skeleton comprises a length configured to minimize a temperature of the flame.

12. The burner of claim 11, wherein the temperature is 3000° F. or less.

13. The combustion system of claim 6, wherein the burner is configured to generate less than 14 Ng/J of $NO_x$.

14. The combustion system of claim 6, wherein the heating appliance is a furnace.

15. A method of heating a building comprising:

feeding a combustion air stream comprising an amount of air and an amount of fuel to a plurality of burners inside a furnace, wherein each of the burners comprises:

a structural skeleton comprising:

a first end coupled to an air/fuel mixer;

a hollow interior; and a plurality of perforations disposed solely along a second end of the structural skeleton configured to control and direct a flow of an air/fuel mixture through the structural skeleton from the hollow interior to an exterior portion of the structural skeleton;

a plurality of skeleton holes positioned solely in a substantially straight line along the first end of the structural skeleton to allow the flame to be carried between the first end and the second end;

a mesh screen disposed about the structural skeleton configured to maintain a flame along an outer circumference of the mesh screen, wherein the mesh screen is configured to allow the air/fuel mixture to pass through the mesh screen and allow the flame to spread along an external surface of the mesh screen; and a cap coupled to the second end of the structural skeleton, wherein the cap comprises a solid material configured to prevent the air/fuel mixture from passing through the cap;

igniting the plurality of burners to generate a flame along an exterior portion of the mesh screen;

operating a fan to pass combustion products from the flame through an interior of a heat exchanger tube;

passing a circulating air stream over an exterior of the heat exchanger tube, wherein the plurality of perforations are positioned along a body of the structural skeleton to direct the flame towards a direction of the circulating air stream; and blowing the circulating air stream into the building.

16. The method of claim 15, further comprising controlling a temperature of the flame to 3000° F. or less.

17. The method of claim 15, further comprising generating an amount of $NO_x$ less than 14 Ng/J of $NO_x$.

18. The method of claim 15, wherein igniting a plurality of burners further comprises using a single igniter to ignite the plurality of burners.

19. The method of claim 18, wherein igniting the plurality of burners further comprises propagating a flame from one burner to the next using a plurality of holes positioned between the burners.

20. The method of claim 15, further comprising mixing an amount of air and an amount of fuel in an air/fuel mixing chamber to generate the combustion air stream prior to feeding it to the one or more burners.

* * * * *